US005201103A

United States Patent [19]

Frosch et al.

[11] Patent Number: 5,201,103

[45] Date of Patent: Apr. 13, 1993

[54] METHOD AND APPARATUS FOR JOINING NONWOVEN FIBER FABRICS, IN PARTICULAR TEXTILE FIBER FABRICS

[75] Inventors: Werner Frosch, Schwanewede; Werner Lasenga, Duelmen, both of Fed. Rep. of Germany

[73] Assignee: Hergeth Hollingsworth GmbH, Duelmen, Fed. Rep. of Germany

[21] Appl. No.: 638,225

[22] Filed: Jan. 7, 1991

Related U.S. Application Data

[63] Continuation of PCT/DE89/00462, filed Jul. 12, 1989.

[30] Foreign Application Priority Data

Jul. 13, 1988 [DE] Fed. Rep. of Germany ..... 3823683

[51] Int. Cl.[5] ..... D04H 1/44

[52] U.S. Cl. ..... 28/117; 28/134

[58] Field of Search ..... 28/117, 263, 103, 116, 28/117, 122, 134, 135; 19/258, 286, 288; 26/18.5, 18.6

[56] References Cited

U.S. PATENT DOCUMENTS 18,487 10/1857 Gitchell et al. ..... 28/117
1,002,177 8/1911 Reynolds ..... 28/117
3,409,945 11/1968 Godwin et al. ..... 28/117
4,854,021 8/1989 Reinehr et al. ..... 28/263

FOREIGN PATENT DOCUMENTS 638604 2/1964 Fed. Rep. of Germany .
1635620 3/1971 Fed. Rep. of Germany .
2110266 6/1972 France .

*Primary Examiner*—Clifford D. Crowder
*Assistant Examiner*—Amy Brooke Vanatta
*Attorney, Agent, or Firm*—Cort Flint; Henry S. Jaudon

[57] ABSTRACT

When joining nonwoven textile fiber webs the fabrics are placed side by side by means of rolls and are commonly transported away. The adjacent webs (7,8) are subjected to a stuffing process (10,36). Thereafter, the stuffed web of larger thickness is slightly stretched by having the successive roll rotate faster than the stuffing roll. In this manner, multiple side by side webs may be joined by fibers near their adjoining edges entangling to interlock and form an integral large-width web.

16 Claims, 3 Drawing Sheets

FIG. 3
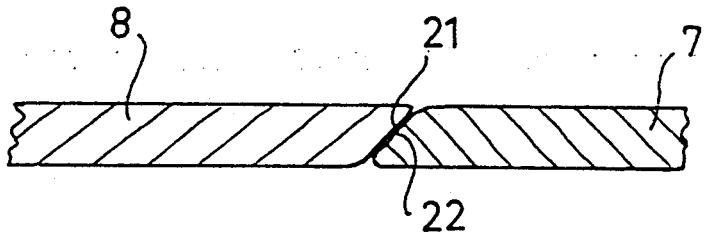
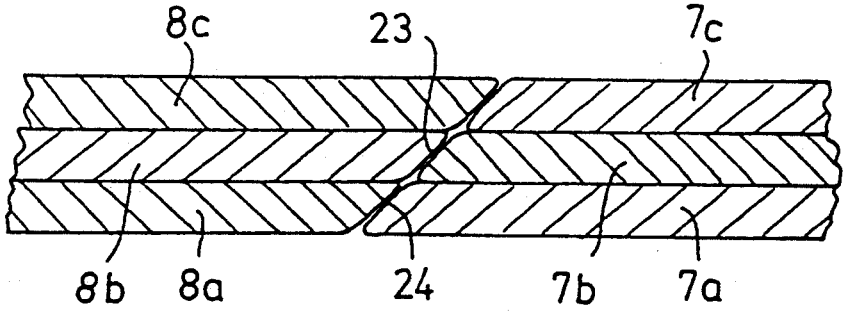
FIG. 4

METHOD AND APPARATUS FOR JOINING NONWOVEN FIBER FABRICS, IN PARTICULAR TEXTILE FIBER FABRICS

This is a continuation of PCT Application No. PCT/DE 8900462, filed Jul. 12, 1989, which designated and elected the United States.

BACKGROUND OF THE INVENTION

The invention relates to a method and apparatus for joining nonwoven fiber webs, in particular textile fiber webs, wherein the webs and the like are laid side by side and transported together.

In order to achieve large web widths several techniques are implemented. The most simple is to join two nonwoven webs by means of rolls, the adjacent margins overlapping each other and being more or less pressed or stuffed by means of rolls. When joining individual nonwoven webs in superposed relationship, a guiding roller is used for the upper web in order to be able to join both webs in the same level. However, it is a problem of the known techniques to achieve a sufficient connection at the seam, i.e. along the adjacent longitudinal edges, of the combined webs obtained by laying the individual webs side by side so that, during the further processing steps, the combined web is not separated partly or completely at the seam.

It is the object of the invention to provide a nonwoven web of large width composed of adjacently arranged webs of small width, wherein the irregularities at the contact area, i.e. the longitudinal edge, are evened and form a homogeneous web.

SUMMARY OF THE INVENTION

The invention is characterized in that the adjacent webs are subjected to a stuffing process and a slight subsequent stretching or drafting.

Such a measure will result in a nonwoven web of great web width, wherein the fibers in the margins are interconnected or entangled such that a uniform and homogenous web is obtained which withstands all relevant stresses during further processing. The interposed stuffing process causes a change in the orientation of the fibers, in particular along the margins of the adjacent or partly overlapping webs so that the seam area may be called homogenous. The web of large width is a uniform web. Due to the stuffing process, the fibers are mixed particularly in the margins of the adjacent webs. This results in an entangling of the fibers at the margins so that the two adjacent webs form a combined web of uniform structure.

According to a further feature of the invention, the stuffing process should be comparatively strong or significant. The stuffing process should have a total delay within a range of 25% to 35%. Preferably, the delay may be 30%.

It is suitable to use at least double webs. The webs may abut at adjacent margins or edges. They may also overlap to a certain extent at the margins. It has been found to be particularly advantageous to achieve the overlapping of the webs at adjacent margins by arranging the edge faces in a bevelled manner. Thus, the entanglement of the fibers of the web will be particularly strong or complete.

Suitably, the individual webs are joined by means of apparatus having a feed drum and at least one successive stuffing roll, as well as a take-off device. The drum and the rolls should rotate in opposite directions. Stuffing in a range of 25% to 35% may be performed with one stuffing roll or it may be performed step by step with a plurality of stuffing rolls.

The rolls arranged behind the stuffing device may rotate at a higher speed than the roll or the rolls of the stuffing device. This allows the stuffing web which is of larger width and more dense to substantially be restored to its initial thickness.

With webs that are doubled once or several times, the webs are suitably laid upon each other such that the seam area itself has a certain width. The entanglement of the fibers within the relatively wide seam area is thus supported.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIGS. 3 and 4 are schematic cross-sectional views of an advantageous embodiment of the seam area of two adjacent webs.

DESCRIPTION OF A PREFERRED EMBODIMENT

Figure 1:
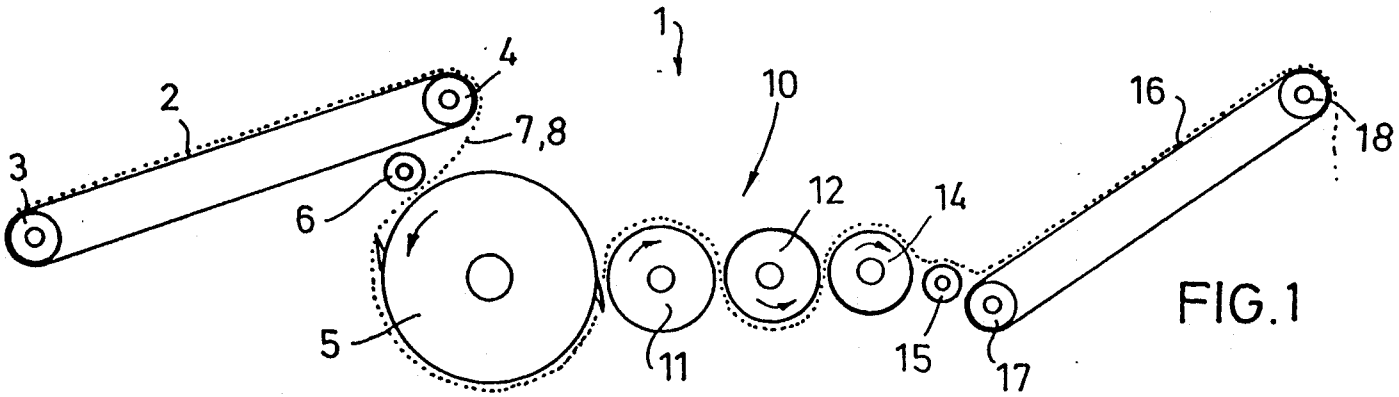
FIGS. 1 and 2 are a schematic side elevational and a top plan view of apparatus for joining nonwoven webs of textile fibers according to the invention.
Figure 2:
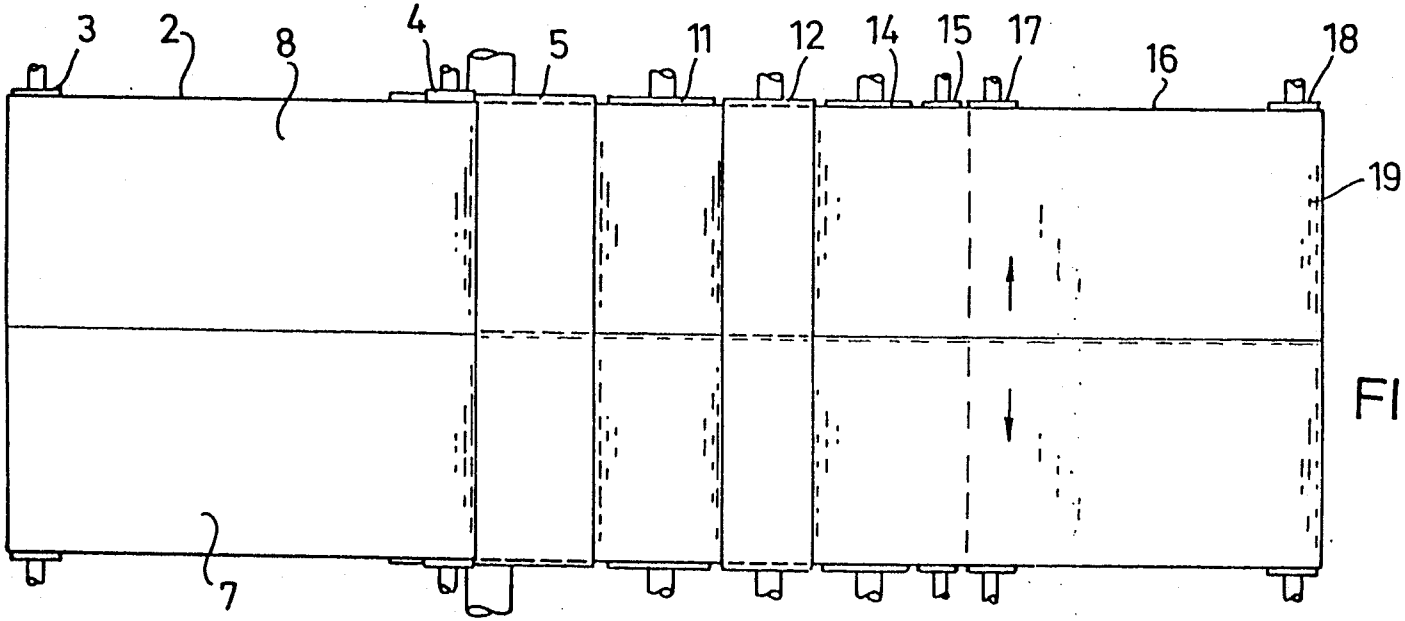

The apparatus 1 for uniting nonwoven webs to form webs of large width has a transport belt 2 that is laid around guiding rollers 3 and 4. Thereafter, a comparatively large drum 5 with a guide roll 6 for the adjacent webs 7 and 8 is provided. In this embodiment, a continuous stuffing device 10 consists, for example, of the stuffing rollers 11 and 12. The area between rollers 11 and 12 constitutes a stuffing area. Preferably, the total delay or retardation of the rolls of the stuffing device 10 is in the range between 25% and 35%, most preferably the delay or retardation is approximately 30% with respect to the circumferential or withdrawal speed of the drum 5. At least one further roll 14 is arranged to receive the web from stuffing device 10. Roll 14 rotates at a higher speed than the circumferential speed of the rollers 11, 12 of the stuffing device, i.e. the delay or slower rate of web movement at the stuffing device 10 with respect to the roll 14 is again positive so that the large-width web is stretched or drafted a little as it exits the stuffing device. By means of a transfer roll 15, the large-width web is conveyed from the roll 14 to a discharge belt 16 which is guided over the guiding rollers 17 and 18.

All of the rolls are of the normal kind or are well known, i.e. they have the usual coverings, i.e. an all-steel card clothing. The rolls rotate in opposite directions. The homogeneous large-width web 19 may then be supplied to other processing apparatus.

When the webs 7,8 are lying side by side with only normal entanglement of the engaging edge fibers, the over feeding by the roll 5 into the stuffing area which is a result of the faster rotational rate of roll 5 relative to the rotational rate of roll 11 will have the result that the layers of the margins of the webs will be compressed which brings about greater engagement and further entangled as the webs become more dense, thus obtaining a uniform web of larger width. This effect is brought about by providing the opposing faces of the marginal edges of the webs with bevels 21, 22 so that with the webs laid side by side, a corresponding overlapping will result as illustrated in FIG. 3. If a plurality of superposed webs 7*a*, 7*b*, 7*c*, and 8*a*, 8*b*, 8*c* are used, it is expedient to arrange the lateral edges 23, 24 in a slightly offset relationship so that the edges can overlap corresponding to a certain bevel as shown in FIG. 4. In this manner, the stuffing process will cause a complete intermingling and subsequent entanglement of the fibers so that a perfectly homogeneous seam area is obtained. The large-width web is joined mechanically through the entanglement of its fibers over its entire width to form a coherent piece, thereby considerably enhancing the quality of the large-width web.

Figure 5:
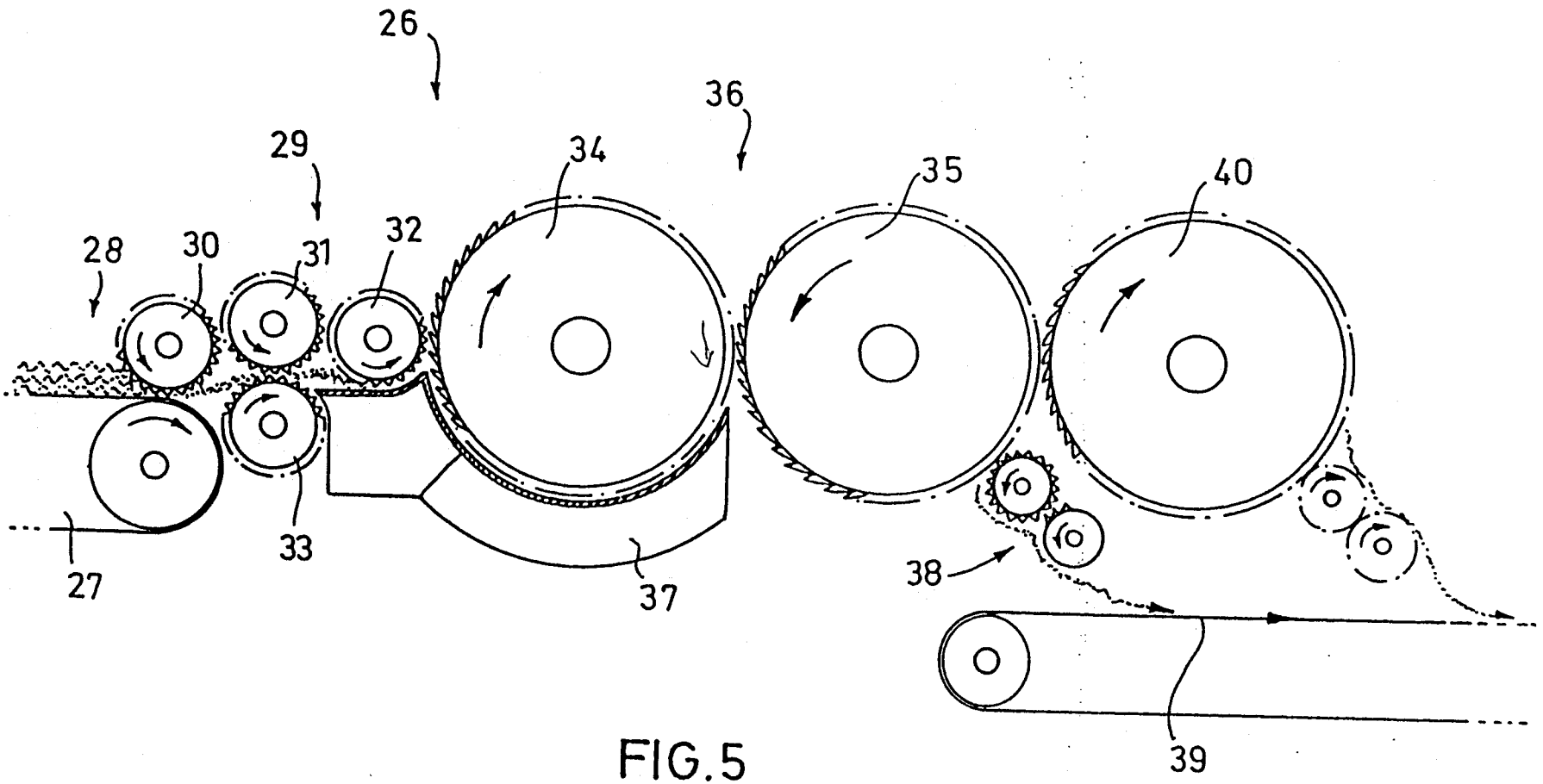
FIG. 5 schematically illustrates another embodiment of apparatus for joining adjacent webs according to the invention.

FIG. 5 illustrates a further apparatus for joining adjacent webs to form a homogenous large-width web. In the device 26 a conveyor belt 27 delivers web 28, which may consist for instance of three layers, to the draw-in device 29. The same may consist of the draw-in rolls 30, 31, 32, and a lower roll 33 completing the set. These web guide rolls should not have any delay with respect to each other so that they rotate at the same speed. Two large drums 34 and 35 constitute the stuffing device. A delay or reduction in the rotational speed between drums 34 and 35 in the range of the stuffing effect, which brings about greater entangling of the fiber ends of the adjacent web edges, is achieved. The drum 34 may have its lower side, i.e. the side free of fibers, provided with a trough 37. The stuffing roll 35 may be followed by a take-off device 38, whereupon the united webs which are now large-width may be transported away by a conveyor belt 39. It is also possible to provide a third drum 40 which would then follow the take-off device 38.

Advantageously, the draw-in rolls 30 to 32 are driven in the same direction of rotation, while drums 34, 35 are driven in opposite directions with respect to each other. The clothings of the rolls and the drums are of the common kind, preferably they are all-steel card clothings. Instead of the take-off device depicted, any other kind of take-off device may be used.

While a preferred embodiment of the invention has been described using specific terms, such description is for illustrative purposes only, and it is to be understood that changes and variations may be made without departing from the spirit or scope of the following claims.

What is claimed is:

1. A method for joining nonwoven fiber webs to form a united web comprising placing adjacent webs side by side on rolls and transporting them through a stuffing area with their opposed longitudinal edges in contact, causing fibers of said opposed edges to become entangled, and transporting said united web away, wherein said method further comprises feeding said webs at a first rate into said stuffing area and withdrawing said webs from said stuffing area at a lesser rate, thereby subjecting said adjacent webs to a stuffing process which creates a stuffed large-width web by compressing said webs causing said fibers of said opposed edges to become entangled, and drawing said large-width web only slightly after said stuffing process so that fibers at said opposed edges are longitudinally oriented and further mechanically interconnected to form said integral large-width web.

2. The method of claim 1 wherein said stuffing process is performed as a result of a delay in the transportation of said web in the stuffing area in a range of between 25% and 35%.

3. The method of claim 2 wherein said delay is approximately 30%.

4. The method of claim 1 including providing said webs with a plurality of layers and joining said plurality of layers.

5. The method of claim 1 including overlapping said webs at their respective opposed edges.

6. The method of claim 5 including providing beveled faces on said opposed edges.

7. Apparatus for joining nonwoven textile webs which includes means for transporting adjacent textile webs arranged side by side with opposed edges in contact, and means for transporting said joined textile webs away, wherein said apparatus comprises:

rotating feed drums for feeding said adjacent webs in said side by side arrangement into a stuffing area;

rotating stuffing means having a rotational speed less than that of said feed drums and a direction of rotation relative to said direction of rotation of said feed drums such as to cause stuffing or condensing of said adjacent webs which causes fibers of said opposed edges to become mechanically entangled and form a single large-width coherent web; and take-off means removing and drawing only slightly said large-width web from said stuffing means.

8. The apparatus of claim 7, wherein said rotational speed of said stuffing means relative to said feed drums constitutes a delay in the feed rate in the stuffing means in a range of about 25% to 35%.

9. The apparatus of claim 8 wherein said stuffing means has a rotational speed which is approximately 30% slower than said feed drum.

10. The apparatus of claim 7 including a trough disposed adjacent to said feed drum on a free side of said feed drum which is free of said web.

11. The apparatus of claim 7 wherein said stuffing means includes at least one stuffing roll which rotates in an opposite direction to said feed drum.

12. The apparatus of claim 11 wherein said takeoff means comprises take-off rolls rotating at a higher rotational speed than the roll of the stuffing means and disposed after said stuffing means, said take-off rolls act to draft slightly said web coming out of said stuffing means which enhances the integral web structure.

13. The apparatus of claim 7 wherein said take-off means includes take-off rolls rotating at a higher circumferential speed than said stuffing means, said take-off rolls acting to draft said web slightly.

14. The apparatus of claim 7 including a plurality of draw-in rolls disposed near said feed drum for feeding said adjacent webs to said feed drum, and each of said draw-in rolls operate at the same rotational speed and in the same direction of rotation.

15. The apparatus of claim 7 wherein said adjacent webs include opposed contacting edges having faces which extend obliquely to each other so that they overlap each other in a bevelled manner.

16. The apparatus of claim 7 wherein said adjacent webs each include a plurality of layers, and each of said layers has a beveled edge which overlaps said layers of an adjacent web.

* * * * *